US005799394A

United States Patent [19]

Rice

[11] Patent Number: 5,799,394

[45] Date of Patent: Sep. 1, 1998

[54] METHOD OF MAKING A MARINE SPEED NOZZLE

[76] Inventor: José Luis Rice, Alejandro Rios Espinoza #88 Col. Benito Juarez, P.O. Box 43-A, Mazatlan, Sinaloa 82180, Mexico

[21] Appl. No.: 596,518

[22] Filed: Feb. 5, 1996

[51] Int. Cl.[6] ..... B23P 15/00

[52] U.S. Cl. ..... 29/889.22; 29/889.1; 29/889.2

[58] Field of Search ..... 415/221; 29/889.22, 29/889.2, 889, 428, 889.1

[56] References Cited

U.S. PATENT DOCUMENTS

| | | | |
|---|---|---|---|
| 4,990,056 | 2/1991 | McClain et al. | 29/889.22 |
| 5,328,327 | 7/1994 | Naudet | 29/889.22 |

*Primary Examiner*—Irene Cuda
*Attorney, Agent, or Firm*—Malloy & Maloy, P.A.

[57] ABSTRACT

A marine speed nozzle assembly to be disposed in surrounding relation about a vessels propeller. The speed nozzle assembly includes an interior shell portion and an exterior shell portion, with the interior shell portion being structured in a circular configuration, so as to define an interior ring, and being disposed in concentrically surrounding relation about the propeller such that fluid propelled by the propeller flows from the interior shell portion's bow end towards its aft end and its generally hydrofoil-like interior longitudinal profile substantially increases a thrust produced by the propeller at low speeds. The exterior shell portion is similarly structured in a circular configuration, thereby defining an outer ring, and is secured to the interior shell portion substantially along corresponding bow and aft edges thereof. The exterior shell portion further includes a generally hydrofoil-like exterior longitudinal profile oriented such that a maximum spacing between the exterior shell portion and the interior shell portion is exhibited generally at the corresponding bow ends thereof, and such that a free running speed provided by the propeller that is surrounded by the interior shell portion is substantially maximized.

8 Claims, 5 Drawing Sheets

METHOD OF MAKING A MARINE SPEED NOZZLE

BACKGROUND OF THE INVENTION

1. Field of the Invention

The present invention relates to a marine speed nozzle which is positioned around the propeller of a ship and is hydrodynamically structured so that it maximizes the thrust provided by the propeller at lowers speeds, while also increasing the free running speed of the vessel.

2. Description of the Related Art

The most common propulsion mechanism used for cruise ships, tankers, freight carriers, steamships, cargo vessels, loading barges, tugboats, and other large marine vessels is the radiating blade propeller. The propeller, which basically is a hub surrounded by a plurality of fan-like blades, is typically located under the rear or aft end of a ship and its rotation accelerates water towards the rear of the ship to effectuate the primary means of driving and maneuvering the vessel.

Those skilled in the art relating to marine propulsion devices have realized that the propulsion efficiency of a ship's propeller may be increased by carefully channelling the incoming water flow to a ships propeller and similarly directing the accelerated water flow efficiently as it leaves the back of the propeller. In the past, various types of conical enclosures or nozzles have been fashioned in an attempt to increase the performance of the ships propeller.

Essentially, a conical enclosure or nozzle surrounds the propeller in a longitudinal direction and directs an optimal amount of water flow into the propeller. The principles of fluid dynamics dictate that the volume of water flowing into the propeller will equal the volume of water flowing out. As such, the diameter of the nozzle is reduced as the water flows rearward and out of the nozzle. Since the volume of water exiting must equal the volume that enters the nozzle, the water flow accelerates as it travels through the nozzle and thereby provides additional thrust to the ship which cannot be achieved by the propeller alone. The additional thrust is demanded by cargo ships, tugboats, freightliners, aircraft carriers, and similar marine vessels which must carry substantial loads or tow heavy cargo while operating at low speeds.

Although the scientific principles underlying the use of a conical enclosure or nozzle to increase a propeller's efficiency are clear, these principles have not yet yielded a practical and functional nozzle design that does not sacrifice performance in normal operating situations to maximize performance at low speed situations. In particular, while reducing the nozzle's inside diameter will increase the speed of the water flow exiting the nozzle, and thereby provide more thrust at low speeds, known nozzle designs have not adequately surmounted the loss of efficiency due primarily to flow interference and turbulence caused by water flowing from the bow or front end of the nozzle towards the aft or rear end of the nozzle and resulting in a flow disturbance encountered by the water jets as they exit the aft or rear end of the nozzle. In particular, known nozzles have not changed the traditional old design and maintain the same conical-straight surface that is inside the nozzle on the outside of the nozzle. As such, the resulting hydrodynamic flow of water around the nozzle, which has no significant effect on performance at low speeds, severely affects the efficiency of the propeller and nozzle as the speed increases. Specifically, because of the conical interior and exterior shapes, as speed increases the shape causes a converging water flow pattern that significantly increases drag while the nozzle is going through the water. In fact, it has been seen that due to the drag affects of the conversing water flow, traditional nozzle section designs can only be used up to 9.5 knots, after which the increased drag overcomes the additional thrust provided by acceleration of the water through the inside of the nozzle and the performance of the propeller suffers.

As such, although the existing nozzle designs may provide an increase in the total thrust effectuated by the propeller, the free running speed of the vessel is substantially compromised. For small recreational powerboats, fishing trawlers, speed boats, marine patrol vessels, and small coast guard auxiliary vessels, for example, an increase in thrust will be superfluous, while a corresponding decline in free running speed completely unsatisfactory. These vessels do not face a problem as they simply can do without installing a nozzle over the propeller. However, both additional thrust and free running speed is demanded by marine vessels which must carry substantial loads or tow heavy cargo, such as tugboats, freightliners, aircraft carriers, and similar vessels. Unfortunately, the use of a marine nozzle to increase thrust substantially hinders the speed of these vessels. Accordingly, many vessels requiring additional thrust find it more economical to replace their existing engines with more expensive, higher horsepower engines than to suffer losses from lower free board speeds caused by the installation of a marine nozzle.

In addition to the losses in running speed which result from the use of conventional marine nozzles, known thrust enhancing nozzles are also generally difficult to manufacture in a durable and effective manner. Specifically, the conical-straight nozzle sections of traditional nozzles generally exhibit a very weak mechanical strength, a weakness that is further increased due to the manufacturing difficulties associated with producing those nozzles. Specifically, conventional nozzles are formed of single, formed, interior and exterior segments. Naturally, it is very difficult to effectively form the single steel piece into a corresponding interior or exterior of the nozzle as during pressing or other molding procedures the material moves along all three axis and is subject to distortion and imprecise formation. Furthermore, the welding surface of the entire structure is limited when the large interior and exterior segments are positioned relative to one another as only an exterior/exposed surface of each segment can be effectively welded. Accordingly, an edge of the segments opposite the weld remains vulnerable to separation and breakage. Also, because in conventional nozzle designs three quarters of the actual nozzles are conical-straight sections, the mechanical strength is very weak, a weakness that is in fact increased because of the previously mentioned welding difficulties that do not permit an internal weld of the outside conical shell. Of course, after a few years of use, the nozzle material ages and the concentrated mechanical stresses in the outer shell cause the nozzle to finally collapse.

Marine nozzles are typically constructed of Carbon steel due to its high strength and relatively low cost. However, because the marine nozzles are naturally exposed to seawater in a very corrosive environment, the carbon steel can easily oxidize or rust after some use. In particular, the most profound oxidation occurs in the high stress areas immediately surrounding the blade tips of the propeller. This is the area of the marine nozzle which experiences the most severe turbulent water flow, and over time, the turbulent water flow erodes the surface layers of oxidized Steel. This cycle continues as subsequent layers of the Steel oxidize or rust and are likewise eroded until finally the portion of the marine nozzle immediately surrounding blade tips of the propeller fails. Accordingly, when the interior portion of a conventional marine nozzle immediately surrounding the blade tips of the propeller becomes excessively worn or rusted, the ship owner must engage in expensive repairs or in many instances replace the entire nozzle. In fact, due to the magnitude of repair costs and down time, it is frequently more economical to purchase a replacement marine nozzle then repair the existing marine nozzle.

SUMMARY OF THE INVENTION

The present invention is directed towards a marine speed nozzle which is to be positioned around the propeller of a marine vessel and is structured in a hydrodynamic shape so that it maximizes the thrust produced by the propeller at lower speeds, while also increasing the free running speed of the vessel during normal operation. The marine speed nozzle includes primarily an interior shell portion and an exterior shell portion. The interior shell portion is structured in a circular configuration, and thereby defines an interior ring. Furthermore, the interior shell portion includes a bow end and an aft end.

The interior shell portion of the marine speed nozzle structured to be disposed in a concentrically surrounding relation about the propeller so that water propelled by the propeller flows therethrough from its bow end towards the its aft end. Further, the interior shell portion includes a generally hydrofoil-like interior longitudinal profile, with the bow end defining a leading end of the hydrofoil-like profile and the aft end defining a trailing end of the hydrofoil-like profile. As such, the interior shell portion of the marine speed nozzle is structured and disposed to substantially increase the thrust produced by the ship's propeller at low speeds.

The exterior shell portion is also structured in a circular configuration, and it defines an outer ring of the marine speed nozzle. In particular, the exterior shell portion also includes a bow end and an aft end and is structured to be secured to the interior shell portion along the corresponding bow and aft edges of the shell portions. The exterior shell portion includes a generally hydrofoil-like exterior longitudinal profile in which the bow end defines a leading end of the hydrofoil-like profile and the aft end defines a trailing end of the hydrofoil-like profile. Further, the exterior shell portion is positioned relative to the interior shell portion such that the maximum spacing between the exterior shell portion and the interior shell portion is at the corresponding bow ends thereof.

Finally, the exterior shell portion is structured and disposed to substantially maximize the free running speed provided by the propeller. This is generally accomplished by substantially minimizing the drag effectuated by water as it passes from the aft end of the exterior shell portion and interacts with the water exiting from the interior shell portion.

It is an object of the present invention to provide a marine speed nozzle that has a hydrodynamic shape so that it increases the free running speed provided by the propeller while also permitting maximum thrust at lower speeds.

It is a further object of the present invention to provide a marine speed nozzle which is structured to minimize the drag effectuated by the water passing over the nozzle.

Another object of the present invention is to provide a marine speed nozzle which is completely rounded so that it minimizes any resistance to advance.

An additional object of the present invention is to provide a marine speed nozzle which can be manufactured and assembled at a substantially low cost.

It is also an object of the present invention to provide a marine speed nozzle in which the aft edge of the nozzle is substantially thin so that the water flow encounters minimum drag as it passes from the aft end of the nozzle.

An additional object of the present invention is to provide a marine speed nozzle in which the interior portion of the nozzle immediately surrounding the blade tip of the propeller is substantially rust-free.

Another object of the present invention is to provide a marine speed nozzle in which the interior portion of the nozzle immediately surrounding the blade tip of the propeller is separately and independently replaceable.

Also an object of the present invention is to provide a marine speed nozzle which is substantially strong and durable.

A further object of the present invention is to provide a method of manufacturing a marine speed nozzle which provides for substantially increased mechanical strength by permitting welding along both sides of each weld surface, and which can be effectively and precisely formed into a 100% curved hydrofoil section.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
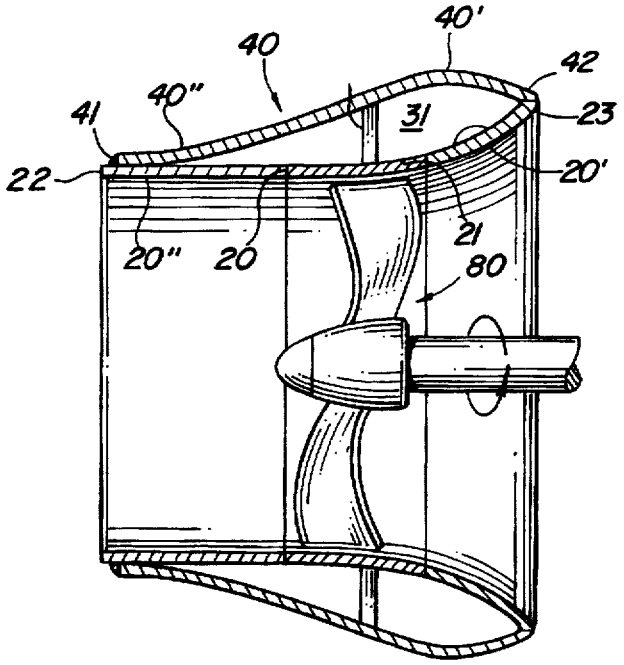
FIG. 1 is a cross-sectional side view of the marine speed nozzle showing the propeller.

Shown throughout the figures, the present invention is directed towards a marine speed nozzle, generally indicated as 10. The marine speed nozzle 10 is structured to be positioned around the propeller 80 of preferably a marine vessel in order to improve the propellers performance in various circumstances. In particular, the marine speed nozzle 10 is structured to maximize a thrust produced by the propeller at lower speeds, while also increasing the free running speed of the vessel during normal open water operation. The marine speed nozzle 10 is configured in a round, hydrodynamically shaped structure and is preferably manufactured from several component parts which are assembled to form the nozzle. Further, the special manufacturing process utilized allows the marine speed nozzle 10 to be produced at a substantially lower cost than conventional marine nozzles.

In particular, the marine speed nozzle 10, which as mentioned is to be disposed in a surrounding relation about a vessel's propeller 80, includes an interior shell portion 20 and an exterior shell portion 40. Looking first to the interior shell portion 20, it is structured in a circular configuration, and thereby defines an interior ring which directly surrounds the propeller 80. Further, the interior shell portion 20 includes a bow end 20' and an aft end 20", and is structured to include a generally hydrofoil-like interior longitudinal profile, with the bow end 20' defining a leading end of the hydrofoil-like interior profile and the aft end 20", likewise defining a trailing end of the hydrofoil-like interior profile. Accordingly, as water is propelled by the propeller 80 and flows through the interior shell portion 20 a thrust that can produced by the propeller as it operates at low speeds is substantially maximized.

It is noted, that the most profound oxidation or rusting of a marine nozzle occurs in the high stress areas immediately surrounding the blade tips of the propeller 80. As such, in conventional marine nozzles the interior portion of the marine nozzle immediately surrounding the blade tips of the propeller tends to become excessively worn or rusted at a much quicker rate than a remainder of the nozzle. Accordingly, with known nozzles, a ship owner must often engage in expensive repairs or in many instances complete replacement of the entire marine nozzle. In the present invention, the bow end 20" of the interior shell portion 20 includes a stainless steel ring 21 structured to directly overly the propeller 80. Naturally, stainless steel is more expensive than Carbon steel; however, the present invention is extremely cost effective in that it selectively utilizes stainless steel around the area immediately surrounding the propeller 80, which is typically the area most severely worn and rusted. The useful life of the marine speed nozzle 10 of the present invention is therefore substantially extended, and if replacement is necessary, only the stainless steel ring 21 need be replaced.

Turning to the exterior shell portion 40, it is also structured in a circular configuration, and it defines an outer ring of the marine speed nozzle 10. The exterior shell portion 40 also includes a bow end 40' and an aft end 40". As such, the exterior shell portion 40 is secured to the interior shell portion 20 substantially along the corresponding bow and aft edges at the respective bow and aft ends of the shell portions.

Figure 8:
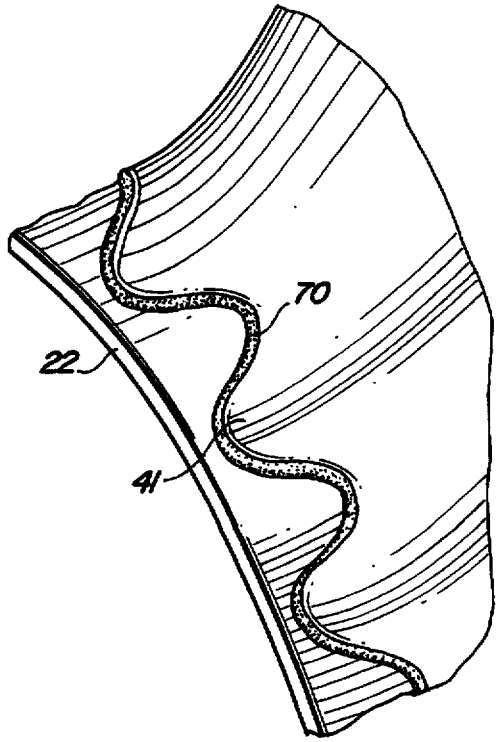
FIG. 8 is an elevated perspective view of a section of the marine speed nozzle, showing that all components of the marine nozzle are curved.
Figure 9:
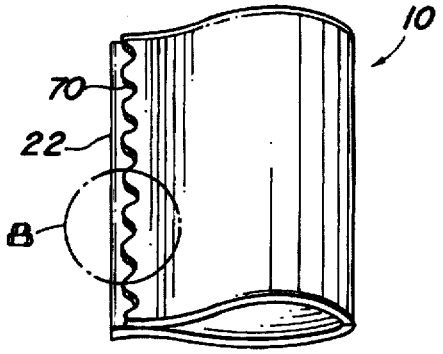
FIG. 9 is an isolated view illustrating the curved weld at the trailing edge, to increase welding length for more structural strength of the nozzle and to facilitate water flow leaving the trailing edge of nozzle and reduce nozzle drag without causing low pressure areas.

The exterior shell portion 40 includes a generally hydrofoil-like exterior longitudinal profile wherein the bow end 40' defines a leading end of the hydrofoil-like exterior profile and the aft end 40" defines a trailing end of the hydrofoil-like exterior profile, and is disposed relative to the interior shell portion 20 so that the maximum spacing between the exterior shell portion 40 and the interior shell portion 20 is exhibited generally at the corresponding bow ends 40' and 20'. Accordingly, the exterior shell portion 40 is structured and disposed to substantially maximize the free running speed provided by the propeller 80 due to the fact that it minimizes the drag effectuated by the water flow as it passes over the aft ends 40" of the exterior shell portions 40. In particular, as fluid exits from within the interior shell portion 20 and merges with the water passing over the exterior shell portion 40, the structure of the present invention maintains a hydrodynamic flow that will not reduce the free running speed of the vessel. Moreover, an aft edge 41 is preferably secured generally to an aft edge 22 of the interior shell portion 20 in a curved weld line 70 as best depicted in FIG. 8. The curved weld line 70 is structured so as to maximize the strength of the weld by increasing the welded contact area, while also ensuring that the aft edge thickness of the marine speed nozzle 10 is limited to the thickness of the aft edge 22 of the interior shell portion 20. This substantially thin aft edge 22 reduces flow interference and turbulence caused by merging water flow as it exits the marine speed nozzle 10.

It is also noted, that in the marine speed nozzle 10 of the present invention, and as part of the previously mentioned hydrofoil-like profiles, the bow end 40" of the exterior shell portion 40 and the bow end 20' of the interior shell portion 20 are preferably generally convex, while at least the aft end 40' of the exterior shell portion 40 is preferably generally concave. Further included in the marine speed nozzle 10 is a transverse rib 30 disposed between the bow end 40" of the exterior shell portion 40 and preferably the stainless steel ring 21 of the bow end 20" of interior shell portion 20, in a generally perpendicular relation therebetween. This transverse rib, which may be a single elongate segment or a plurality of individual segments, is structured to provide substantial reinforcement to the marine speed nozzle 10, at its bow end, without requiring substantial added weight be introduced into the nozzle.

Figure 2:
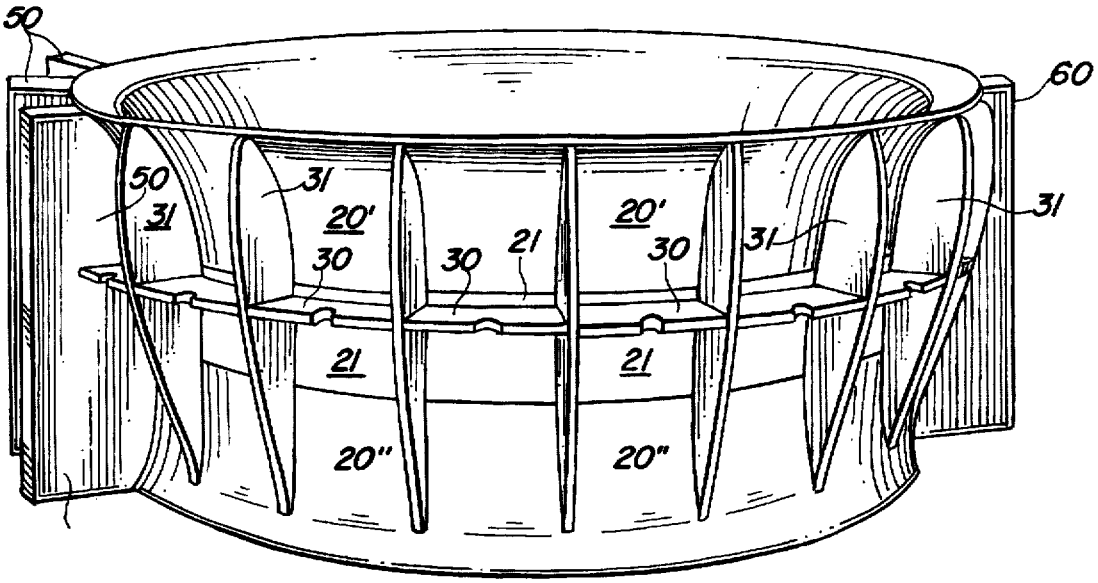
FIG. 2 is a side view of the marine speed nozzle without its exterior shell portion installed, showing the 3 curved members forming the inside shell.
Figure 7:
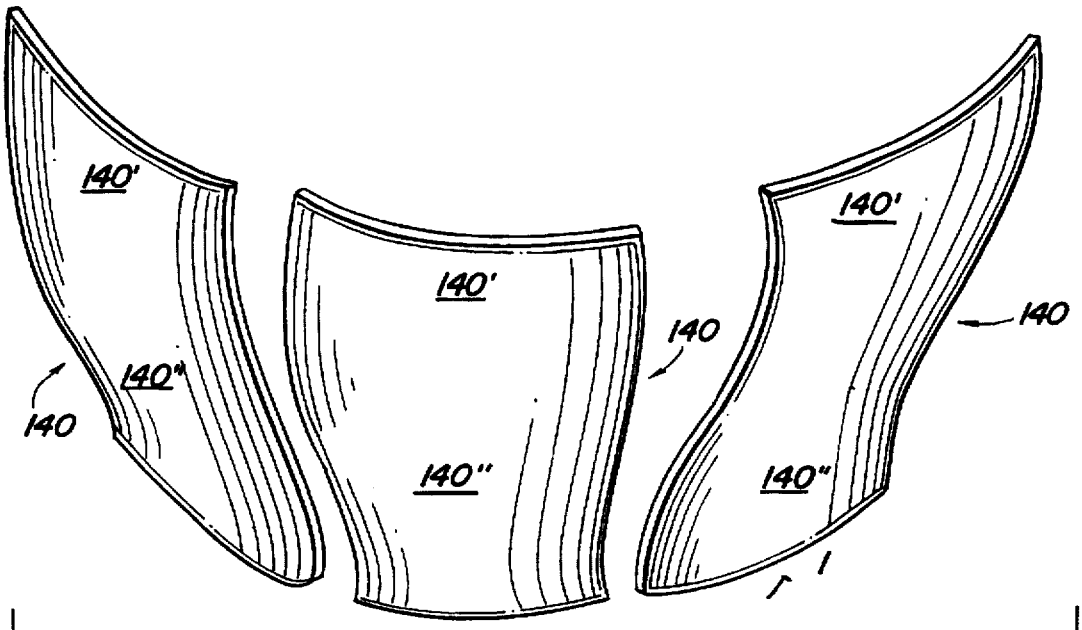
FIG. 7 is a perspective view, showing some of the exterior curved members before they are assembled to form the exterior shell portion of the marine speed nozzle.
Figure 4A:
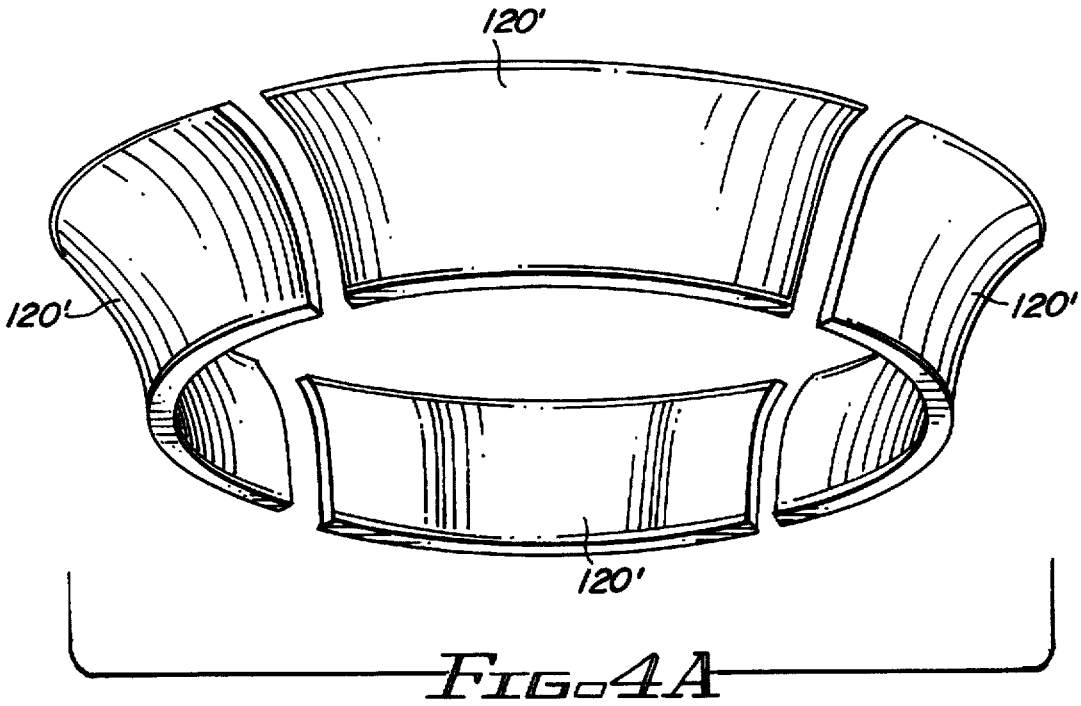
FIG. 4A is a perspective view, from below, showing 4 bow curved members before they are assembled to form an exterior shell portion of the bow end.
Figure 4B:
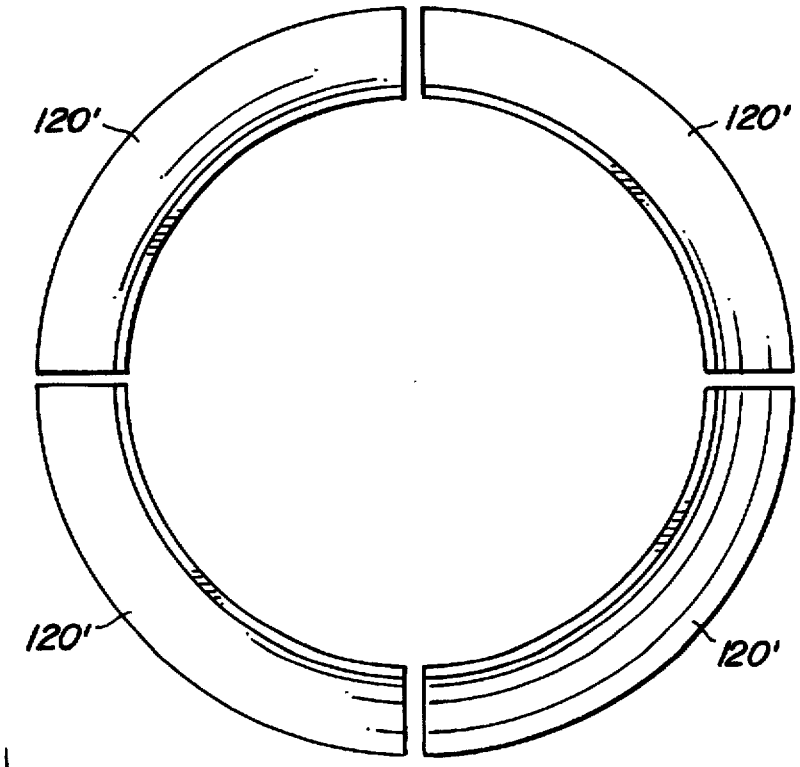
FIG. 4B is a bottom view, showing 4 curved bow end members before they are assembled to form an exterior shell portion of the bow end.
Figure 5A:
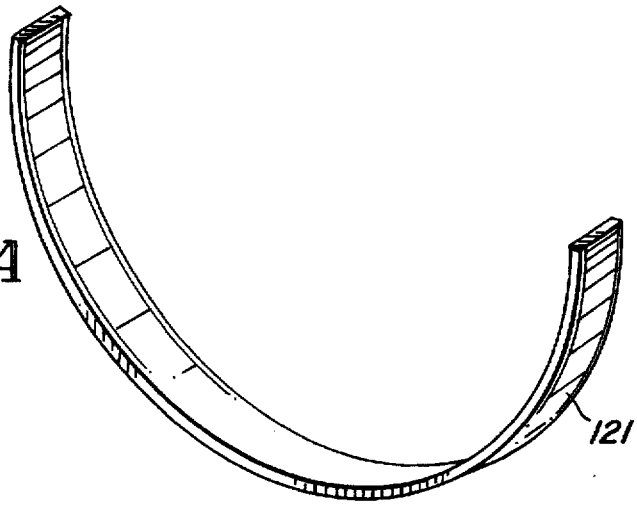
FIG. 5A is perspective view, showing a stainless steel member before it is rolled into a stainless steel ring.
Figure 5B:
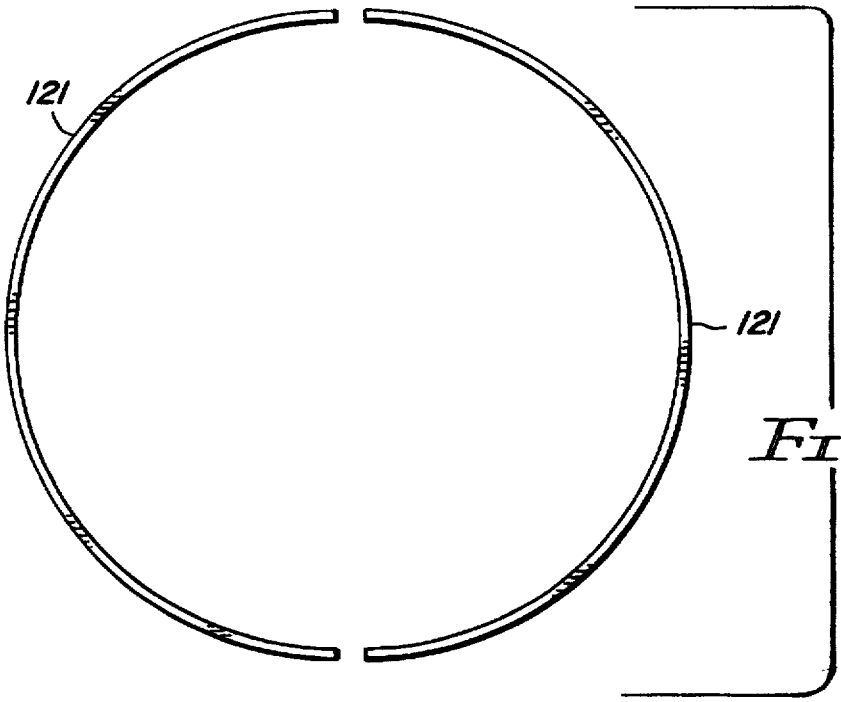
FIG. 5B is a top view, showing two stainless steel rolled ring members before they are cut and formed into 4 curved stainless steel rings.
Figure 10:
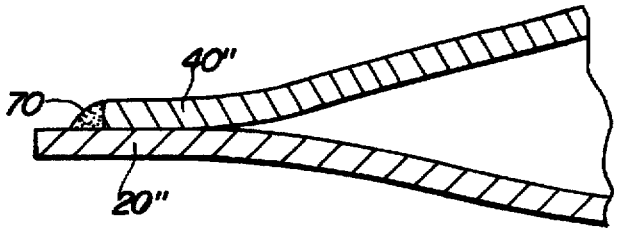
FIG. 10 is a cross sectional view illustrating the trailing edge of the nozzle, and showing the facilitation of water flow leaving the nozzle.
Figure 6A:
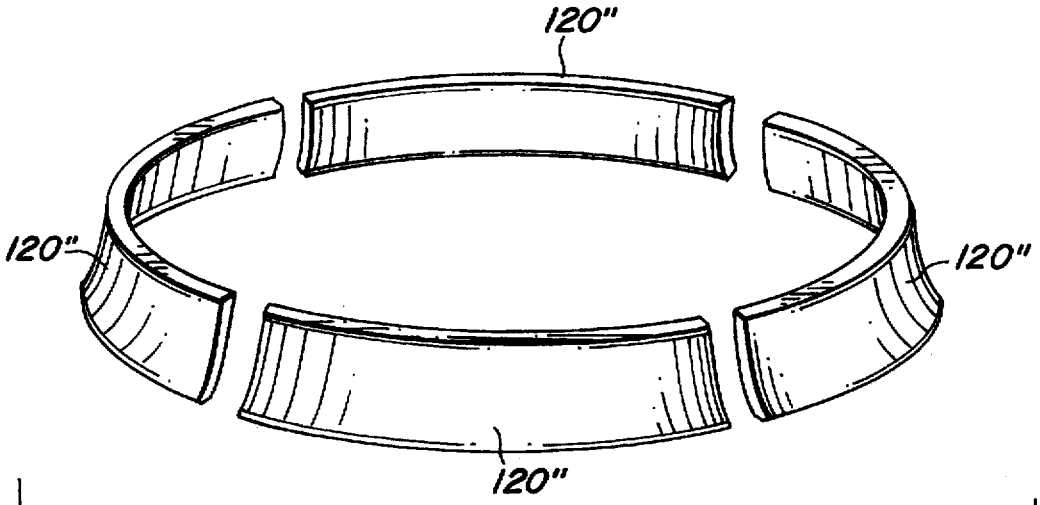
FIG. 6A is a perspective view, showing 4 curved aft members before they are assembled to form the exterior shell portion aft end.
Figure 6B:
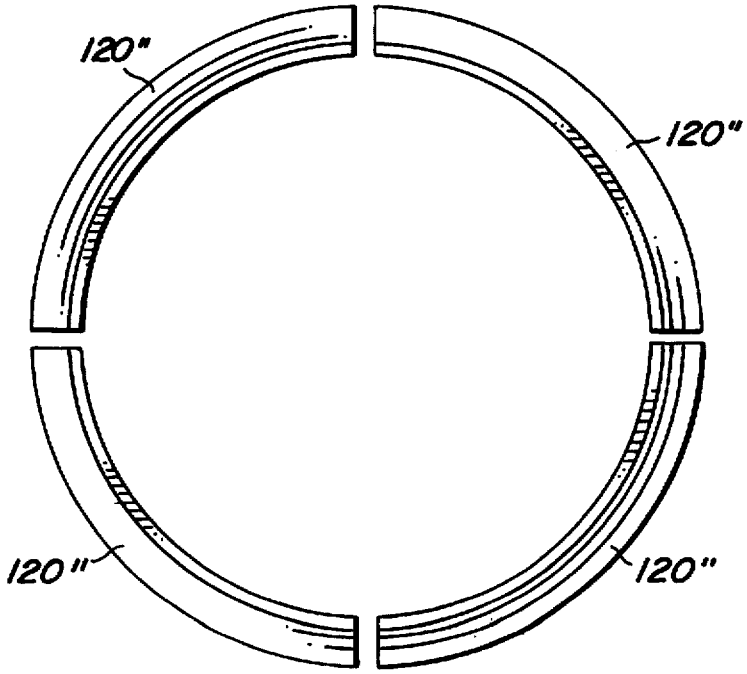
FIG. 6B is a top view, showing 4 aft members before they are assembled to form the interior shell portion aft end.

Similarly, so as to reinforce the marine speed nozzle along its longitudinal axis, but about the entire perimeter thereof, a plurality of longitudinal, generally perpendicular separators 31 are disposed between the exterior shell portion 40 and the interior shell portion 20, at least at the bow ends thereof. These separators extend about a circumference of the marine speed nozzle 10, between the interior and exterior shell portions thereof, and are each positioned a spaced apart distance from one another, as best shown in FIG. 2. In the preferred embodiment, a majority of the separators 31 are disposed at a spacing of about 18 degrees from one another. It will be noted, however, that the distance the separators are spaced apart from one anther can be varied.

Figure 3:
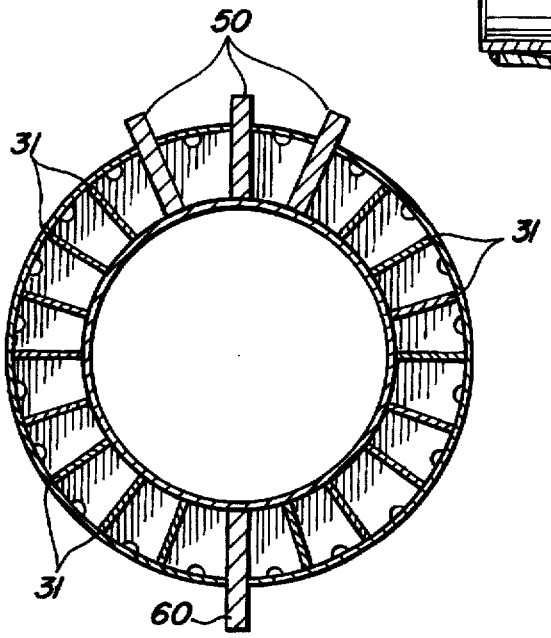
FIG. 3 is a cross-sectional front view looking longitudinally into the nozzle.

Additionally, the marine speed nozzle 10 includes at least one longitudinal upper strut member 50 and at least one longitudinal lower strut member 60, as best in FIG. 3. The strut members 50 and 60 are structured to be strong and secure and preferably provide an extension at which the marine speed nozzle 10 can be secured to the vessel in surrounding relation about the propeller. To provide increased securing ability, in the preferred embodiment the marine speed nozzle 10 includes three upper strut members 50. Preferably, those upper strut members 50 are disposed at a spacing of approximately 22.5 degrees apart from one another. Further, the strut members 50 and 60 are disposed in a generally perpendicular relation to the interior shell portion 20 and are located at opposite sides of the interior shell portion 20. In order to facilitate securing of the marine speed nozzle 10 to the vessel, so that the vessel's propeller 80 is surroundingly disposed within the interior shell portion 20, the strut members 50 and 60 are structured to protrude out through the exterior shell portion 40.

In the preferred embodiment, the blade tip clearance between the interior shell portion 20 and a tip of the propeller 80 will be equivalent to about 0.4% of a diameter of the propeller 80, as this helps to obtain the best performance out of the marine speed nozzle. Along the same lines, in the preferred embodiment of the marine speed nozzle 10, the longitudinal length of the interior shell portion 20 is about 50% of an interior diameter of the interior stainless steel ring 21 defined by the interior shell portion 20.

Preferably, the marine speed nozzle 10 is constructed of several component plates, which may be formed primarily from carbon steel, or a similar metal, and partially from stainless steel in the case of the previously recited stainless steel ring 21. Further, the method used in manufacturing the marine speed nozzle 10 allows for simple and low cost assembly of the marine speed nozzle 10, and provides a well rounded hydrodynamic shape to be obtained.

Manufacture of the marine speed nozzle 10 begins by press forming a plurality of interior bow end members 120', with a specifically configured press mold, to a desired longitudinal profile and a desired camber such that a predetermined number of the interior bow end members 120' may at least partially define a precise, circular interior shell portion bow end 20' of a desired interior diameter. In the preferred embodiment, 4 interior bow end members 120' are assembled of carbon steel to form the precise, circular interior shell portion bow end 20'.

Next a plurality of stainless steel ring members 121 are press formed, with a specifically configured press mold and in much the same manner as the interior bow end members 120' are press formed, to a desired longitudinal profile and a desired camber so that a predetermined number of the stainless steel ring members 121 can define the precise, circular stainless steel ring 21. In the preferred embodiment, two stainless steel ring members 121 shaped in half circles are sufficient to form the stainless steel ring 21. Preferably, the stainless steel ring 21 will have a front edge interior diameter corresponding to a rear edge interior diameter of the interior shell portion bow end 20.

A plurality of interior aft end members 120" are then press formed, with a specifically configured press mold, to a desired longitudinal profile and a desired camber such that a predetermined number of the interior aft end members 120" may define a precise, circular interior shell portion aft end 20". Preferably, a front edge interior diameter of the interior shell portion aft end 20" corresponds a rear edge interior diameter of the stainless steel ring 21.

After a predetermined number of interior aft end members 120" are formed, the next step involves positioning these members in abutting engagement with one another about a specifically sized ring template. In the preferred embodiment, 4 press formed interior aft end members 120' are assembled to form the precise, circular interior shell portion aft end 20'. Once disposed about the template, the predetermined number of interior aft end members 120" are secured to one another, preferably through welding, and thereby form the interior shell portion aft end 20".

After the interior shell portion aft end 20" is in place, the next step involves positioning the predetermined number of stainless steel ring members 121 in adjacent, abutting engagement with one another, about the specifically sized ring template, and atop of the front edge of the interior shell portion aft end 20". The stainless steel ring member 121 are then secured with one another, such as by welding, so as to form the stainless steel ring 21 and at least partially form the interior shell portion bow end 20', and to the front edge of the interior shell portion aft end 20" so as to further define the interior shell portion 20.

Once the stainless steel ring 21 is in place, a predetermined number of bow end members 120' are positioned in adjacent, abutting engagement with one another about the specifically sized ring template and atop the front edge of the stainless steel ring 21. The bow end members are then secured to one another, such as by welding, so as to further form the interior shell portion bow end 20', and to the stainless steel ring 21, thereby completing the formation of the interior shell portion 20.

The next step involves the securing, such as by welding, of at least one, but preferably three longitudinal upper struts 50 in a generally perpendicular orientation to an exterior surface of the interior shell portion 20, as best shown in FIG. 3. Subsequently, at least one longitudinal lower strut 60 is secured, in a generally perpendicular orientation, to the exterior surface of the interior shell portion 20 at a point substantially opposite the location of the upper strut portion 50.

In a similar manner, a plurality of longitudinal separators 31 are then secured, in a perpendicular orientation, to the exterior surface of the interior shell portion 20 at spaced apart distances from one another, as shown in FIG. 3. Although any number of longitudinal separators 31 may be used, in the preferred embodiment, there will be twenty longitudinal separators 31 secured in place, such as through welding.

Next, at least one transverse rib 30 is secured in a generally perpendicular orientation about an exterior circumference of the stainless steel ring 21, between the upper and lower struts 50 and 60 and between the longitudinal separators 31. It is noted that the transverse rib 30 may include a single elongate segment, which may also have a number of slots to fit the separators and struts, or may include a plurality of smaller segments welded in place between the separators and struts.

A plurality of exterior shell members 140 are then press formed to a desired longitudinal profile and a desired camber, such that a predetermined number of the exterior shell members define a precise, circular exterior shell portion 40 of a desired interior diameter. The predetermined number of exterior shell members 140 are then positioned in adjacent, abutting engagement with one another, and with the upper and lower struts 50 and 60, about the interior shell portion 20. In the preferred embodiment, 10 of the exterior shell members 140 are press formed and positioned to define the exterior shell portion 40. The exterior shell members are then secured to one another and at the corresponding locations to the upper and lower struts, so as to form the exterior shell portion 40, and to the interior shell portion 20 at corresponding bow edges and aft edges thereof so as to form the completed marine speed nozzle 10. It is noted, that the exterior shell members 140 may include cut outs or like recesses to accommodate fitted engagement with the upper and lower struts 50 and 60 that protrude therethrough. Further, in the preferred embodiment, an additional step of welding the aft edge 41 of the exterior shell portion 40 generally at the aft edge 22 of the interior shell portion 20 in a curved weld line is also included.

It is noted that the preferred embodiment of the marine speed nozzle assembly 10 of the present invention is formed from a plurality of smaller individual sections. The use of the smaller individual sections provides for more accurate and precise formation of each individual section into an effective hydrofoil type configuration without compromising the remaining portions of the nozzle. Moreover, formation in individual segments, as with the method and structure of the present invention, enables welded interconnection of the components at both an outer and interior surface of each respective part. Such comprehensive interior and exterior welding significantly increases the mechanical strength of the nozzle and extends its durability for many years of repeated use. In fact, the material construction of the nozzle assembly provides for 100% curved sections instead of the conical-straight sections of traditional nozzles that provide weak points in the strength of the nozzle and minimize the effective formation of the hydrofoil configuration.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described, what is claimed is:

1. A method of manufacturing an improved marine speed nozzle comprising the steps of:

(a) press forming a plurality of interior bow end members to a desired longitudinal profile and a desired camber such that a predetermined number of the interior bow end members at least partially define a precise, circular interior shell portion bow end of a desired interior diameter, (b) press forming a plurality of stainless steel ring members to a desired longitudinal profile and a desired camber such that a predetermined number of the stainless steel ring members define a precise, circular stainless steel ring having a front edge interior diameter corresponding a rear edge interior diameter of said interior shell portion bow end, (c) press forming a plurality of interior aft end members to a desired longitudinal profile and a desired camber such that a predetermined number of the interior aft end members define a precise, circular interior shell portion aft end having a front edge interior diameter corresponding a rear edge interior diameter of said stainless steel ring, (d) positioning said predetermined number of interior aft end members in adjacent, abutting engagement with one another about a specifically sized ring template, (e) securing said predetermined number of interior aft end members to one another, so as to form said interior shell portion aft end, (f) positioning said predetermined number of stainless steel ring members in adjacent, abutting engagement with one another about the specifically sized ring template and atop said front edge of said interior shell portion aft end, (g) securing said predetermined number of stainless steel members to one another, so as to form said stainless steel ring and at least partially form said interior shell portion bow end, and to said interior shell portion aft end, (h) positioning said predetermined number of interior bow end members in adjacent, abutting engagement with one another about the specifically sized ring template and atop said front edge of said stainless steel ring, (i) securing said predetermined number of interior bow end members to one another, so as to further form said interior shell portion bow end, and to said stainless steel ring, thereby defining an interior shell portion, (j) securing at least one longitudinal upper strut, in a generally perpendicular orientation, to an exterior surface of said interior shell portion, (k) securing at least one longitudinal lower strut, in a generally perpendicular orientation, to said exterior surface of said interior shell portion at a point substantially opposite said upper strut portion, (l) securing a plurality of longitudinal separators, in a generally perpendicular orientation, to said exterior surface of said interior shell portion a spaced apart distance from one another between said upper and said lower struts, (m) securing at least one transverse rib, in a generally perpendicular orientation, to said stainless steel ring, about an exterior circumference thereof and between said upper and lower struts and said longitudinal separators, (n) press forming a plurality of exterior shell members to a desired longitudinal profile and a desired camber such that a predetermined number of the exterior shell members define a precise, circular exterior shell portion of a desired interior diameter, (o) positioning said predetermined number of exterior shell members in adjacent, abutting engagement with one another and said upper and lower struts, and about said interior shell portion, and (p) securing said predetermined number of exterior shell members to one another and said upper and lower struts, so as to form said exterior shell portion, and to said interior shell portion at a bow edge and an aft edge thereof.

2. A method of manufacturing an improved marine speed nozzle as recited in claim 1 further comprising the step of securing three of said longitudinal upper struts, in a generally perpendicular, spaced apart orientation, to said exterior surface of said interior shell portion.

3. A method of manufacturing an improved marine speed nozzle as recited in claim 1 further comprising the step of welding said aft edge of said exterior shell portion generally at said aft edge of said interior shell portion in a curved weld line.

4. A method of manufacturing an improved marine speed nozzle as recited in claim 1 further comprising the step of press forming 4 interior bow end members to said desired longitudinal profile and said desired camber so as to define said precise, circular interior shell portion bow end of said desired interior diameter.

5. A method of manufacturing an improved marine speed nozzle as recited in claim 1 further comprising the step of press forming 2 of said stainless steel ring members to said desired longitudinal profile and said desired camber so as to define said precise, circular stainless steel ring.

6. A method of manufacturing an improved marine speed nozzle as recited in claim 1 further comprising the step of press forming 4 of said interior aft end members to said desired longitudinal profile and said desired camber so as to define said precise, circular interior shell portion aft end.

7. A method of manufacturing an improved marine speed nozzle as recited in claim 1 further comprising the step of press forming 10 of said exterior shell members to said desired longitudinal profile and said desired camber so as to define said precise, circular exterior shell portion of said desired interior diameter.

8. A method of manufacturing an improved marine speed nozzle as recited in claim 1 further comprising the step of securing 20 longitudinal separators, in said generally perpendicular orientation, to said exterior surface of said interior shell portion said spaced apart distance from one another between said upper and said lower struts.

* * * * *